US011715906B2

(12) United States Patent
Matsuda

(10) Patent No.: US 11,715,906 B2
(45) Date of Patent: Aug. 1, 2023

(54) CONNECTOR

(71) Applicant: SUMITOMO WIRING SYSTEMS, LTD., Mie (JP)

(72) Inventor: Hidekazu Matsuda, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 68 days.

(21) Appl. No.: 17/400,500

(22) Filed: Aug. 12, 2021

(65) Prior Publication Data

US 2022/0069519 A1 Mar. 3, 2022

(30) Foreign Application Priority Data

Aug. 27, 2020 (JP) ..... 2020-143815

(51) Int. Cl.
*H01R 13/627* (2006.01)
*H01R 12/71* (2011.01)

(52) U.S. Cl.
CPC ..... *H01R 13/6273* (2013.01); *H01R 12/716* (2013.01)

(58) Field of Classification Search
CPC ..... H01R 13/6273; H01R 12/716; H01R 13/633; H01R 13/518
See application file for complete search history.

(56) References Cited

U.S. PATENT DOCUMENTS

| | | | | |
|---|---|---|---|---|
| 5,472,354 | A * | 12/1995 | Chen | H01R 12/732 439/357 |
| 7,179,094 | B2 | 2/2007 | Kawahara et al. | |
| 2002/0002012 | A1 | 1/2002 | Torii | |
| 2019/0052003 | A1* | 2/2019 | Hasegawa | H01R 12/91 |
| 2019/0052005 | A1* | 2/2019 | Hasegawa | H01R 13/405 |
| 2020/0014145 | A1* | 1/2020 | Motohashi | H01R 13/42 |
| 2020/0366008 | A1* | 11/2020 | Maruno | H01R 12/53 |
| 2021/0408727 | A1* | 12/2021 | Fan | H01R 13/639 |
| 2022/0069519 | A1* | 3/2022 | Matsuda | H01R 13/6273 |
| 2022/0224046 | A1* | 7/2022 | Iida | H01R 13/4364 |

FOREIGN PATENT DOCUMENTS

| | | |
|---|---|---|
| JP | 2015-072872 A | 4/2015 |
| JP | 2015-220213 A | 12/2015 |

* cited by examiner

*Primary Examiner* — Abdullah A Riyami
*Assistant Examiner* — Nelson R. Burgos-Guntin
(74) *Attorney, Agent, or Firm* — Venjuris, P.C.

(57) ABSTRACT

A connector 10 includes a board-side housing 21 to be installed on a circuit board 100, and mating housings 61A, 61B to be connected to the board-side housing 21. The board-side housing 21 includes front and back walls 26, 27, left and right walls 28, 29 and accommodation chambers 32A, 32B arranged between the front and back walls 26, 27 and between the left and right walls 28, 29 and open upward. The mating housings 61A, 61B include protruding portions 78 exposed above the board-side housing 21 and protruding toward both front and back sides beyond the front and back walls 26, 27 with the mating housings 61A, 61B accommodated in the accommodation chambers 32A, 32B.

6 Claims, 8 Drawing Sheets

CONNECTOR

CROSS-REFERENCE TO RELATED APPLICATIONS

This application is based on and claims priority from Japanese Patent Application No. 2020-143815, filed on Aug. 27, 2020, with the Japan Patent Office, the disclosure of which is incorporated herein in their entireties by reference.

TECHNICAL FIELD

The present disclosure relates to a connector.

BACKGROUND

A connector disclosed in Japanese Patent Laid-open Publication No. 2006-127974 includes a housing to be installed on a circuit board. The housing includes four side walls on front, back, left and right sides and an opening among the four side walls. A mating housing (not described in Japanese Patent Laid-open Publication No. 2006-127974) is inserted and accommodated into the opening of the housing from above. Note that a connector to be installed on a circuit board is also disclosed in Japanese Patent Laid-open Publication Nos. 2015-072872, 2015-220213, and 2000-182694.

SUMMARY

The mating housing includes a lock portion for the connector in a part to be exposed above the housing with the mating housing accommodated in the opening of the housing. In separating the mating housing from the housing, a locked state is released by pressing the lock portion and, in that state, the mating housing is pulled out from the opening. However, the exposed part of the mating housing, including the lock portion, tends to become narrower to meet a need for miniaturization, thereby causing a problem that it is difficult to pinch the exposed part with fingers.

Accordingly, the present disclosure aims to provide a connector capable of improving workability in separating a mating housing.

The present disclosure is directed to a connector with a board-side housing to be installed on a circuit board, and a mating housing to be connected to the board-side housing, wherein the board-side housing includes front and back walls facing each other in a front-back direction, left and right walls facing each other in a lateral direction and an accommodation chamber arranged between the front and back walls and between the left and right walls and open upward, and the mating housing includes protruding portions exposed above the board-side housing and protruding in the front-back direction beyond the front and back walls with the mating housing accommodated in the accommodation chamber.

According to the present disclosure, it is possible to provide a connector capable of improving workability in separating a mating housing.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
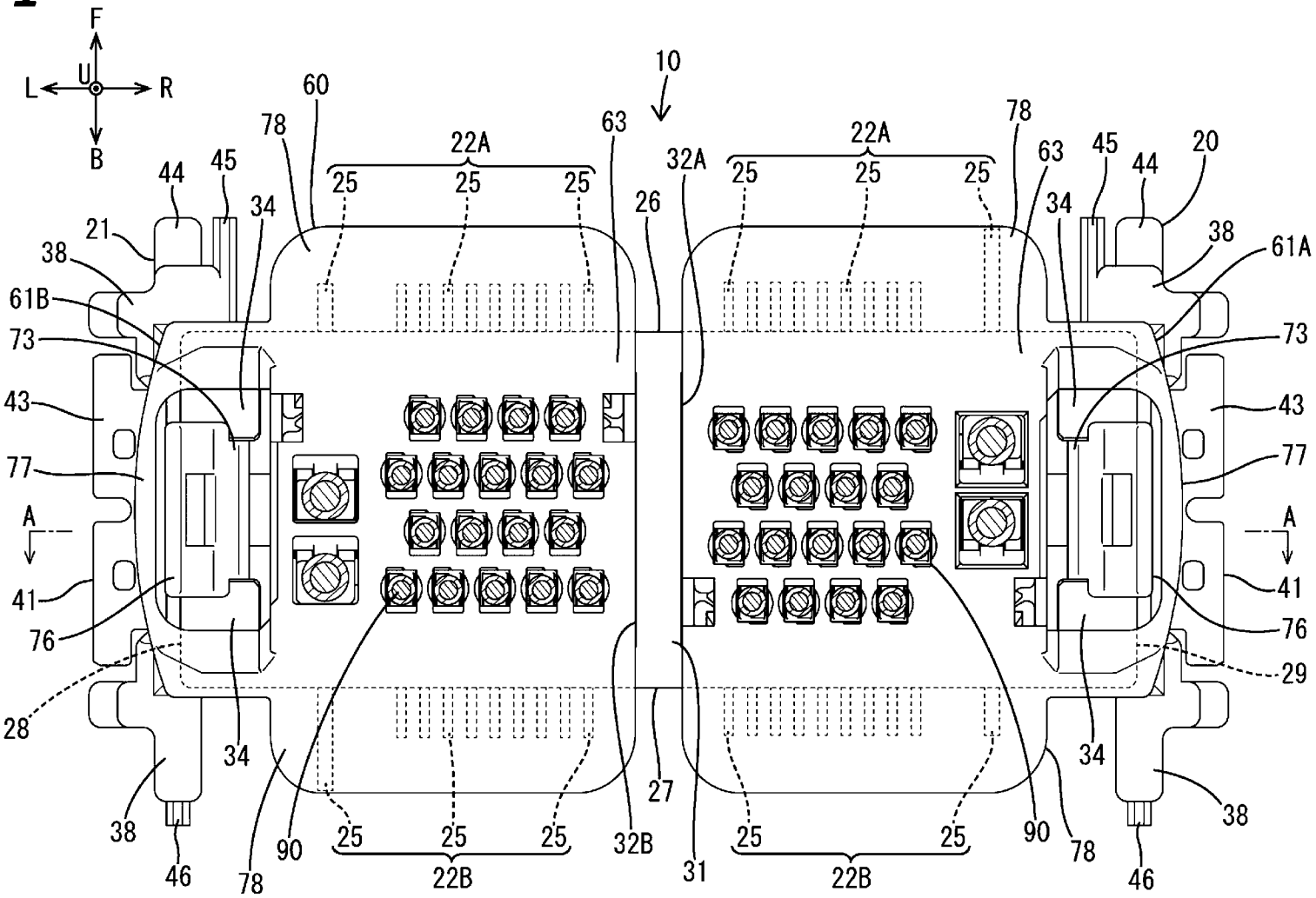
FIG. 1 is a plan view showing a state where a board-side connector and a mating connector are connected to each other in a connector of one embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

[Description of Embodiments of Present Disclosure]

First, embodiments of the present disclosure are listed and described.

(1) The connector of the present disclosure includes a board-side housing to be installed on a circuit board, and a mating housing to be connected to the board-side housing, wherein the board-side housing includes front and back walls facing each other in a front-back direction, left and right walls facing each other in a lateral direction and an accommodation chamber arranged between the front and back walls and between the left and right walls and open upward, and the mating housing includes protruding portions exposed above the board-side housing and protruding toward both front and back sides beyond the front and back walls with the mating housing accommodated in the accommodation chamber.

According to the above configuration, a worker can easily pinch the protruding portions protruding toward the both front and back sides. Thus, the worker can easily pull up and separate the mating housing from the board-side housing while pinching the protruding portions.

(2) Preferably, a plurality of the accommodation chambers are arranged side by side in the lateral direction in the board-side housing. According to this configuration, since the protruding portions of the mating housing protrude in the front-back direction orthogonal to the lateral direction, which is an arrangement direction of the accommodation chambers, with the mating housings accommodated in the respective accommodation chambers, the mutual interference of the respective protruding portions can be avoided. Further, the enlargement of the board-side housing in the lateral direction can be avoided.

(3) Board-side terminals may be mounted into the board-side housing, the board-side terminal may include a board connecting portion to be connected on the circuit board, the board connecting portions may be exposed below the board-side housing and arranged to project toward the both front and back sides beyond the front and back walls, and the protruding portions may be arranged to cover the board connecting portions from above with the mating housing accommodated in the accommodation chamber. According to this configuration, since the protruding portions protect the board connecting portions of the board-side terminals from above, the interference of an external matter with the board connecting portions from above can be avoided. As a result, the connection reliability of the board connecting portions and the circuit board can be maintained.

(4) The left and right walls may include a board-side lock portion and the mating housing includes a mating lock portion to be locked to the board-side lock portion on a side surface facing the left or right wall with the mating housing accommodated in the accommodation chamber. According to this configuration, since the board-side lock portion is provided on the left or right wall, the enlargement of the board-side housing in the front-back direction can be avoided. Further, the board-side housing is easily set to have a front-back symmetrical shape unlike the case where the board-side lock portion is provided on either one of the front and back walls. As a result, for example, the board-side terminals having the same shape can be arrayed in each of front and back rows of the board-side housing and the types of the board-side terminals can be reduced.

(5) A fixing member for fixing the board-side housing to the circuit board may be mounted on the left or right wall and arranged at a position overlapping the board-side lock portion in the front-back direction. According to this configuration, even if the fixing member is mounted on the left or right wall, the enlargement of the board-side housing in the front-back direction can be avoided.

(6) The board-side lock portion may be provided on an inner surface facing the accommodation chamber and the fixing member may be mounted on an outer surface opposite to the inner surface, out of the inner and outer surfaces of the left or right wall. According to this configuration, a degree of freedom in designing each of the board-side lock portion and the fixing member can be enhanced.

[Details of Embodiment of Present Disclosure]

A specific example of the present disclosure is described below with reference to the drawings. Note that the present invention is not limited to this illustration and is intended to be represented by claims and include all changes in the scope of claims and in the meaning and scope of equivalents.

Embodiment

Figure 2:
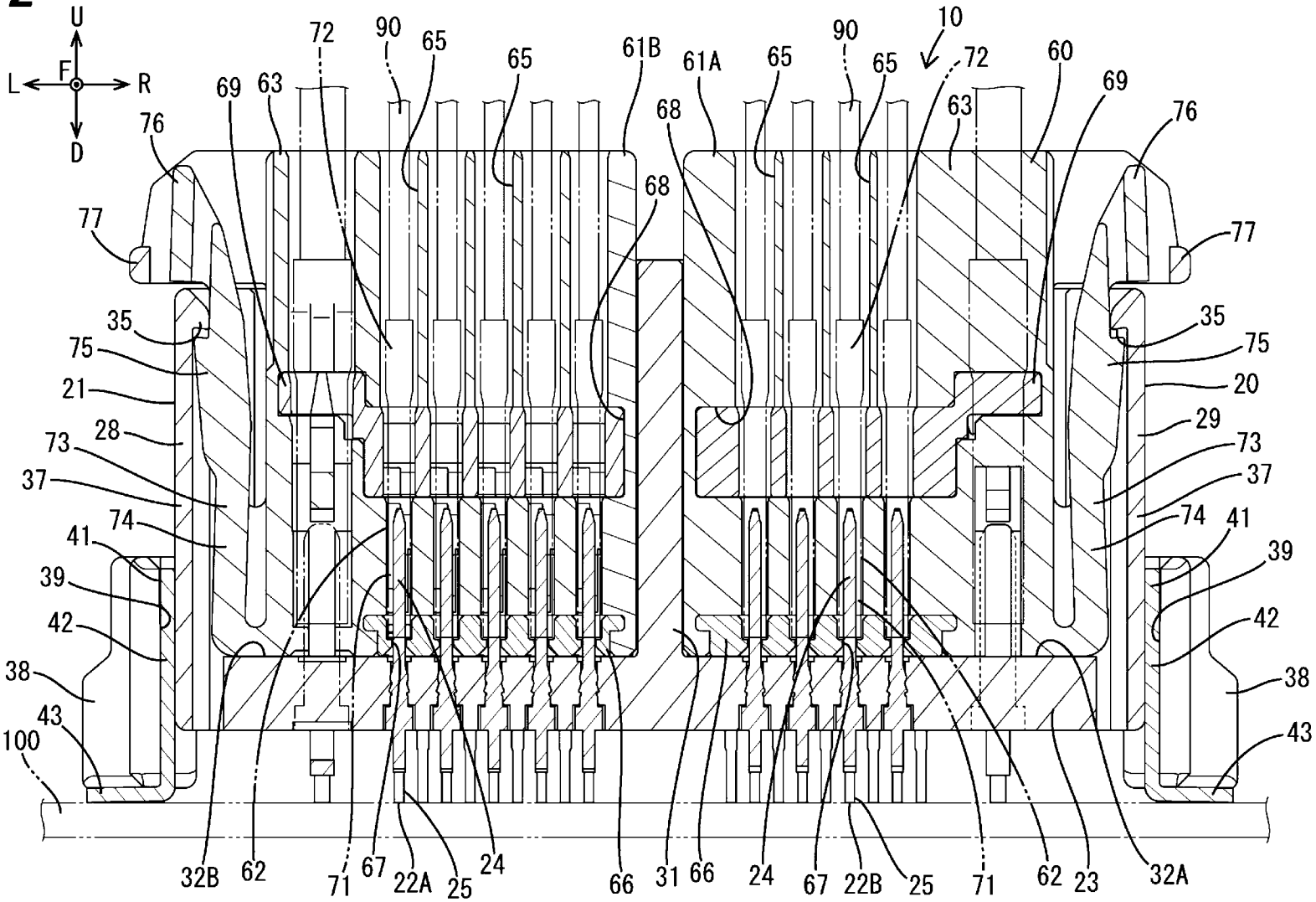
FIG. 2 is a section along A-A of FIG. 1.

As shown in FIGS. 1 and 2, a connector 10 of one embodiment includes a board-side connector 20 and a mating connector 60 connectable to the board-side connector 20. The board-side connector 20 includes a board-side housing 21 and board-side terminals 22A, 22B to be mounted into the board-side housing 21. The mating connector 60 includes mating housings 61A, 61B and mating terminals 62 to be mounted into the mating housings 61A, 61B. As shown in FIG. 2, the board-side connector 20 is placed on the upper surface of a circuit board 100.

Figure 3:
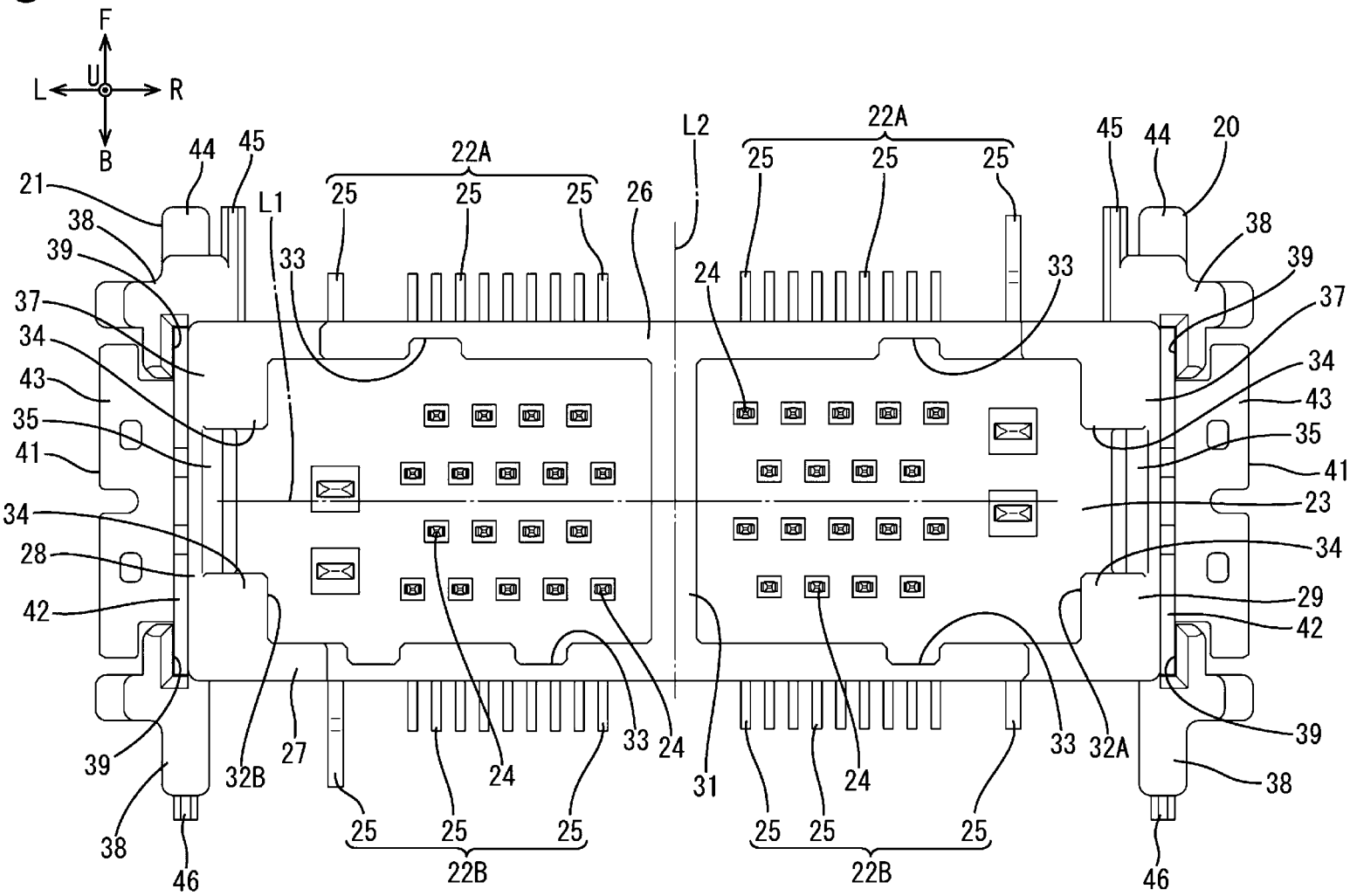
FIG. 3 is a plan view of the board-side connector.

Note that, in the following description, a vertical direction is based on a vertical direction of each of FIGS. 2 and 6 to 8. An upper side in each of FIGS. 1 and 3 is referred to as a front side concerning a front-back direction. A lateral direction is based on a lateral direction of each of FIGS. 1 to 5 and 7. In this specification, an upper surface side of the circuit board 100 shown in FIG. 2 is merely referred to as an upper side and the vertical direction does not indicate a positional relationship and a direction in actual usage. Similarly, the front-back direction and lateral direction also merely indicate two orthogonal directions along a plate surface of the circuit board 100. In each figure, "U" and "D" denote upper and lower sides, "F" and "B" denote front and back sides, and "L" and "R" denote left and right sides.

(Board-Side Connector)

Figure 4:
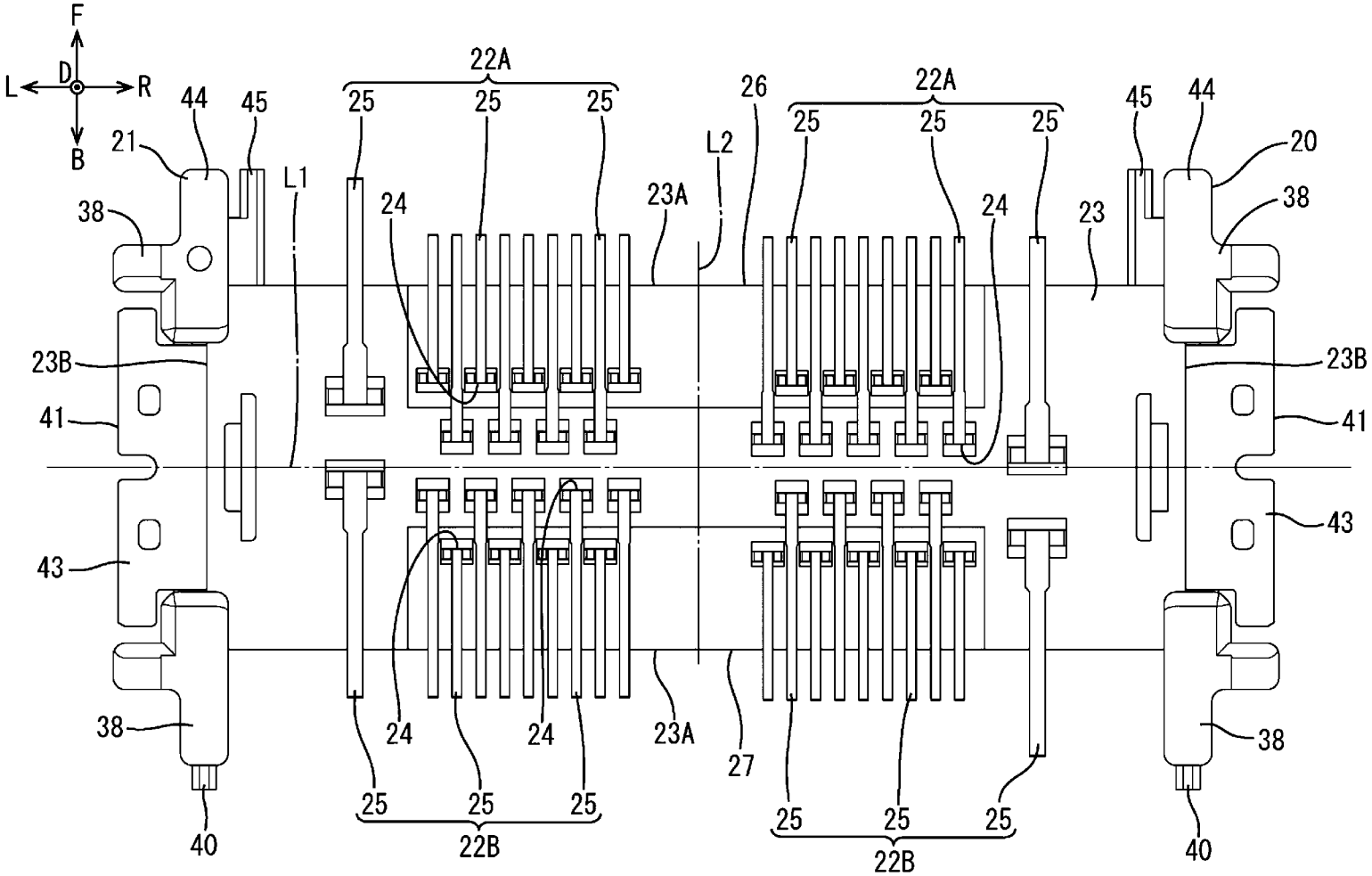
FIG. 4 is a bottom view of the board-side connector.

The board-side housing 21 is made of synthetic resin and, as shown in FIGS. 2 to 4, in the form of a rectangular tube as a whole. The board-side housing 21 includes a bottom wall 23 for closing a lower surface. The bottom wall 23 is in the form of a rectangular plate and defined by long sides 23A long in the lateral direction and short sides 23B short in the front-back direction as shown in FIG. 4.

The plurality of board-side terminals 22A, 22B are mounted through the bottom wall 23. The board-side terminal 22A, 22B is made of conductive metal and pin- or tab-like and includes, as shown in FIG. 2, a mate connecting portion 24 extending in the vertical direction and a board connecting portion 25 bent from the lower end of the mate connecting portion 24 and extending in the front-back direction. The mate connecting portion 24 is arranged to penetrate through the bottom wall 23 as described above. The board connecting portion 25 is arranged along the upper surface of the circuit board 100 below the bottom wall 23 and soldered and connected to an unillustrated conductive portion of the circuit board 100. Note that the board-side connector 21 is of a surface-mount type in this embodiment. The mate connecting portions 24 of the respective board-side terminals 22A, 22B are arranged in a plurality of columns in the lateral direction and in a plurality of rows in the front-back direction on the bottom wall 23 and, as shown in FIG. 4, shifted in the lateral direction between adjacent ones of the rows in the front-back direction. As shown in FIGS. 3 and 4, the respective board-side terminals are composed of a plurality of front-row terminals 22A having the mate connecting portions 24 in two rows mounted in a region in front of a center in the front-back direction of the bottom wall 23 and a plurality of back-row terminals 22B having the mate connecting portions 24 in two rows mounted in a region behind the center in the front-back direction of the bottom wall 23.

The board-side housing 21 includes front and back walls 26, 27 rising upward from the long sides 23A of the bottom wall 23 and left and right walls 28, 29 rising upward from the short sides 23B of the bottom wall 23. As shown in FIG. 3, the front and back walls are composed of the front wall 26 located on a front side and a back wall 27 located on a back side. The left and right walls are composed of the left wall 28 located on a left side and the right wall 29 located on a right side.

As shown in FIG. 3, the front and back walls 26, 27 are facing each other in the front-back direction. The left and right walls 28, 29 are facing each other in the lateral direction. Lengths in the lateral direction of the front and back walls 26, 27 are longer than lengths in the front-back direction of the left and right walls 28, 29. The board-side housing 21 includes a separation wall 31 along the front-back direction in a central part in the lateral direction. The separation wall 31 rises from the bottom wall 23 and both ends thereof in the front-back direction are coupled to the front and back walls 26, 27.

As shown in FIGS. 2 and 3, the board-side housing 21 includes accommodation chambers 32A, 32B open upward above the bottom wall 23 and inside the front and back walls 26, 27 and the left and right walls 28, 29. A pair of the accommodation chambers 32A, 32B are arranged on both left and right sides across the separation wall 31 in the board-side housing 21. The respective mate connecting portions 24 are arranged to project into the respective accommodation chambers 32A, 32B. Further, as shown in FIG. 2, the mating housings 61A, 61B are inserted and accommodated into the respective accommodation chambers 32A, 32B from above.

As shown in FIG. 3, the front and back walls 26, 27 are line-symmetrically arranged with respect to a virtual axis L1 along the lateral direction passing through a center in the front-back direction, except at recesses 33 to be described later. The left and right walls 28, 29 are line-symmetrically arranged with respect to a virtual axis L2 along the front-back direction passing through a center in the lateral direction, except at protecting portions 38 to be described later.

As shown in FIG. 4, the board-side housing 21 is symmetrical on both front and back sides of the virtual axis L1, whereby differences in the front-back lengths of the board connecting portions 25 can be made smaller or eliminated between the respective front-row terminals 22A and the respective back-row terminals 22B. As a result, the respective front-row terminals 22 and the respective back-row terminals 22B can include terminals having the same shapes and same dimensions and, consequently, the types of the board-side terminals 22A, 22B can be reduced.

As shown in FIG. 3, the inner surfaces of the front and back walls 26, 27 are surfaces facing the accommodation chambers 32A, 32B and include the recesses 33 for preventing erroneous fitting of the mating housings 61A, 61B. The outer surfaces of the front and back walls 26, 27 are surfaces facing forward and backward and arranged along the lateral direction and vertical direction as a whole.

The inner surfaces of the left and right walls 28, 29 include thick guide walls 34 projecting toward the accommodation chambers 32A, 32B on both front and back sides. The front and back guide walls 34 extend over the entire lengths in the vertical direction of the left and right walls 28, 29 and are coupled to the front and back walls 26, 27.

The inner surfaces of the left and right walls 28, 29 include board-side lock portions 35 between the front and back guide walls 34. The board-side lock portions 35 are in the form of ribs extending in the front-back direction on the inner surfaces of the upper ends of the left and right walls 28, 29 and both front and back ends thereof are coupled to the guide walls 34.

Figure 8:
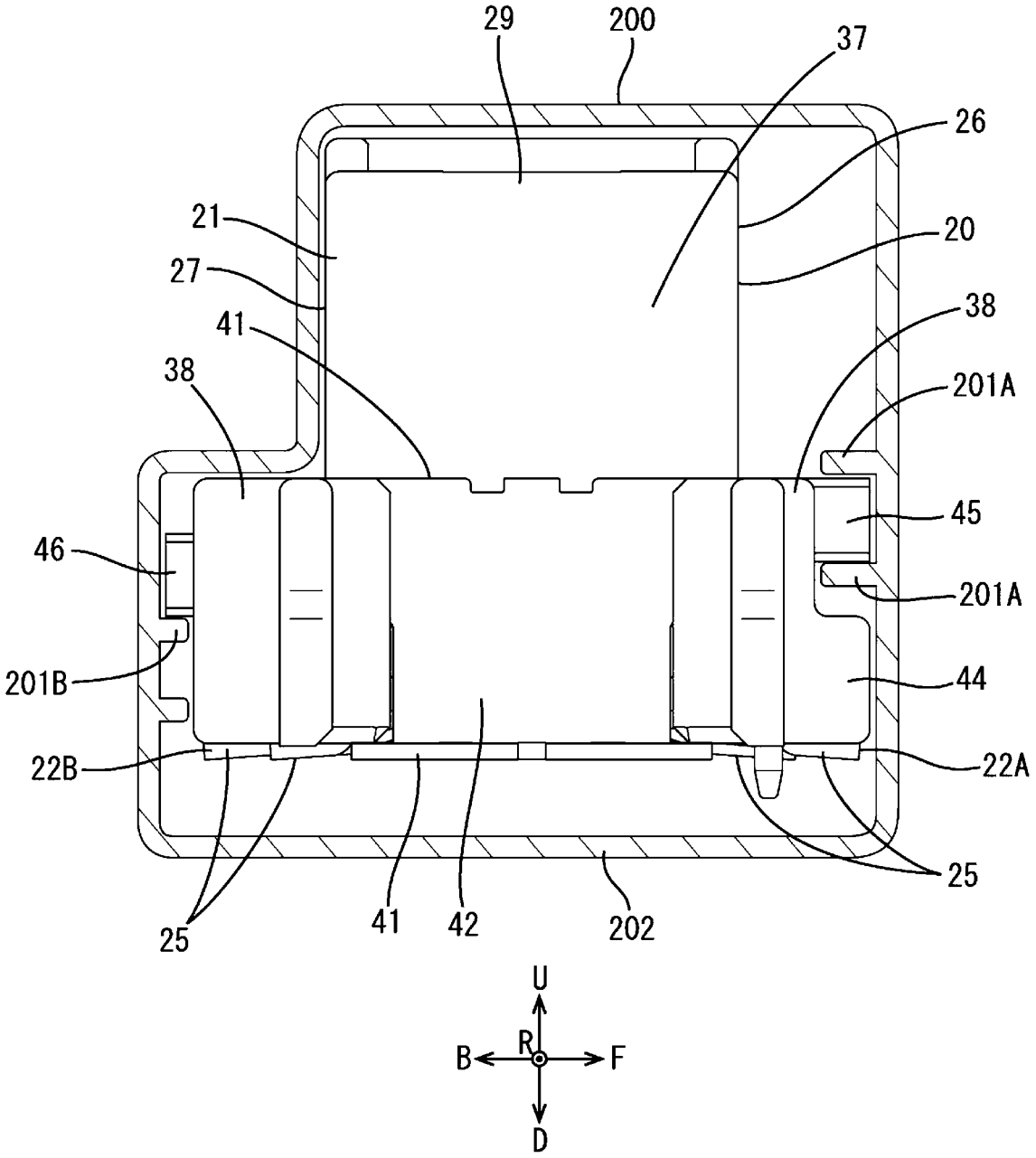
FIG. 8 is a side view of the board-side connector packaged in a transport stick.

The guide walls 34 and the board-side lock portions 35 are provided on side wall bodies 37 of the left and right walls 28, 29. The side wall bodies 37 are connected at a right angle to left and right ends of the front and back walls 26, 27 and arranged between the front and back walls 26, 27. The outer surfaces of the side wall bodies 37 are surfaces facing leftward and rightward and arranged along the front-back direction and vertical direction as a whole as shown in FIG. 8.

As shown in FIG. 3, the left and right walls 28, 29 include the protecting portions 38 projecting from the front and back ends of lower parts of the side wall bodies 37 on four corners of the board-side housing 21. The protecting portions 38 are provided with mounting grooves 39 in inner surfaces facing each other in the front-back direction. The mounting grooves 39 are slit grooves extending in the vertical direction and open upward. As shown in FIG. 2, a groove surface of the mounting groove 39 is continuous with the outer surface of the side wall body 37.

As shown in FIGS. 2 and 3, fixing members 41 are respectively mounted on the left and right walls 28, 29. The fixing member 41 is a plate member made of metal and includes a housing mounting portion 42 and a board fixing portion 43. The housing mounting portion 42 is arranged along the vertical direction with plate surfaces thereof facing leftward and rightward. The board fixing portion 43 is arranged along the lateral direction with the plate surfaces thereof facing upward and downward. The board fixing portion 43 is connected to the lower edge of the housing mounting portion 42. As shown in FIG. 2, the fixing member 41 is L-shaped in a front view by being composed of the housing mounting portion 42 and the board fixing portion 43. The housing mounting portion 42 is arranged along the outer surface of the side wall body 37, and held on the board-side housing 21 with the front and back end edges thereof fit in the mounting grooves 39. The board fixing portion 43 is located on the lower end of the board-side connector 20 and soldered and fixed to the upper surface of the circuit board 100. The fixing member 41 mounted on the left wall 28 is arranged with the board fixing portion 43 facing leftward. The fixing member 41 mounted on the right wall 29 is arranged with the board fixing portion 43 facing rightward. The board-side housing 21 is mounted on the circuit board 100 via the fixing members 41.

The fixing members 41 are mounted in the protecting portions 38 located below the board-side lock portions 35 on the left and right walls 28, 29. As shown in FIG. 3, the board-side lock portions 35 and the fixing members 41 are respectively arranged to overlap each other in the front-back direction on the inner and outer surfaces of the left and right walls 28, 29. Specifically, the board-side lock portion 35 is arranged in a formation range of the fixing member 41 in the front-back direction.

The board connecting portions 25 of the respective board-side terminals 22A, 22B are arranged between the respective protecting portions 38 facing each other in the lateral direction. The board connecting portions 25 of the respective board-side terminals 22A, 22B are protected from both left and right sides by the respective protecting portions 38.

As shown in FIGS. 3 and 8, the front protecting portions 38 connected to both left and right ends of the front wall 26 include protecting body portions 44 projecting forward in lower parts. The protecting body portions 44 are in the form of rectangular columns and arranged to cover the respective board-side terminals 22A from lateral sides. The front protecting portions 38 include piece portions 45 projecting forward in upper parts. The piece portions 45 are in the form of plates along the vertical direction and arranged inwardly of the protecting body portions 44 in a width direction (right side in the case of the left protecting portion 38, left side in the case of the right protecting portion 38) as shown in FIG. 3. The protecting body portions 44 and the piece portions 45 are arranged away from each other in the lateral direction when viewed from above as shown in FIG. 3, and arranged away from each other in the vertical direction when viewed laterally as shown in FIG. 8.

As shown in FIGS. 3 and 8, the back protecting portions 38 connected to both left and right ends of the back wall 27 include second piece portions 46 projecting backward. The second piece portions 46 are in the form of plates along the vertical direction and provided on intermediate parts of the protecting portions 38 in the lateral direction and vertical direction. Backward projection dimensions of the second piece portions 36 are smaller than forward projection dimensions of the piece portions 45.

As shown in FIG. 8, the board-side connector 20 is shipped while being accommodated in a transport stick 200. The transport stick 200 is a tubular case, and the board-side connector 20 is inserted and accommodated into the transport stick 200 through one opening. The board-side connector 20 is packed in the transport stick 200 to prevent breakage.

The transport stick 200 includes rail portions 201A, 201B respectively on wall surfaces facing each other in the front-back direction. With the board-side connector 20 accommodated in the transport stick 200, the second piece portions 46 are supported in contact with the back rail portions 201B and the piece portions 45 are supported in contact with the front rail portions 201A. In particular, each piece portion 45 is inserted and held between a pair of upper and lower rail portions 201A. Thus, the board-side connector 20 is arranged in a state floating from a lower wall 202 of the transport stick 200. As a result, the interference of the board connecting portions 25 and the like of the respective board-side terminals 22A, 22B with the lower wall 202 of the transport stick 200 can be avoided.

In the case of this embodiment, the front ends of the piece portions 45 are arranged at the same position as or backward of the front ends of the protecting body portions 44 in the front-back direction. That is, the piece portions 45 are not shaped to independently project forward of the board-side housing 21. Thus, the external size of the board-side connector 20 does not become large even if including the piece portions 45. Similarly, the external size of the transport stick 200 for packing the board-side connector 20 does not become large. Further, in the case of this embodiment, it is sufficient to prepare only a movable mold movable in the vertical direction and a fixed mold as molds for molding the piece portions 45 and a slide mold or the like needs not be separately prepared. As a result, the complication of a mold structure can be avoided.

(Mating Connector)

Figure 5:
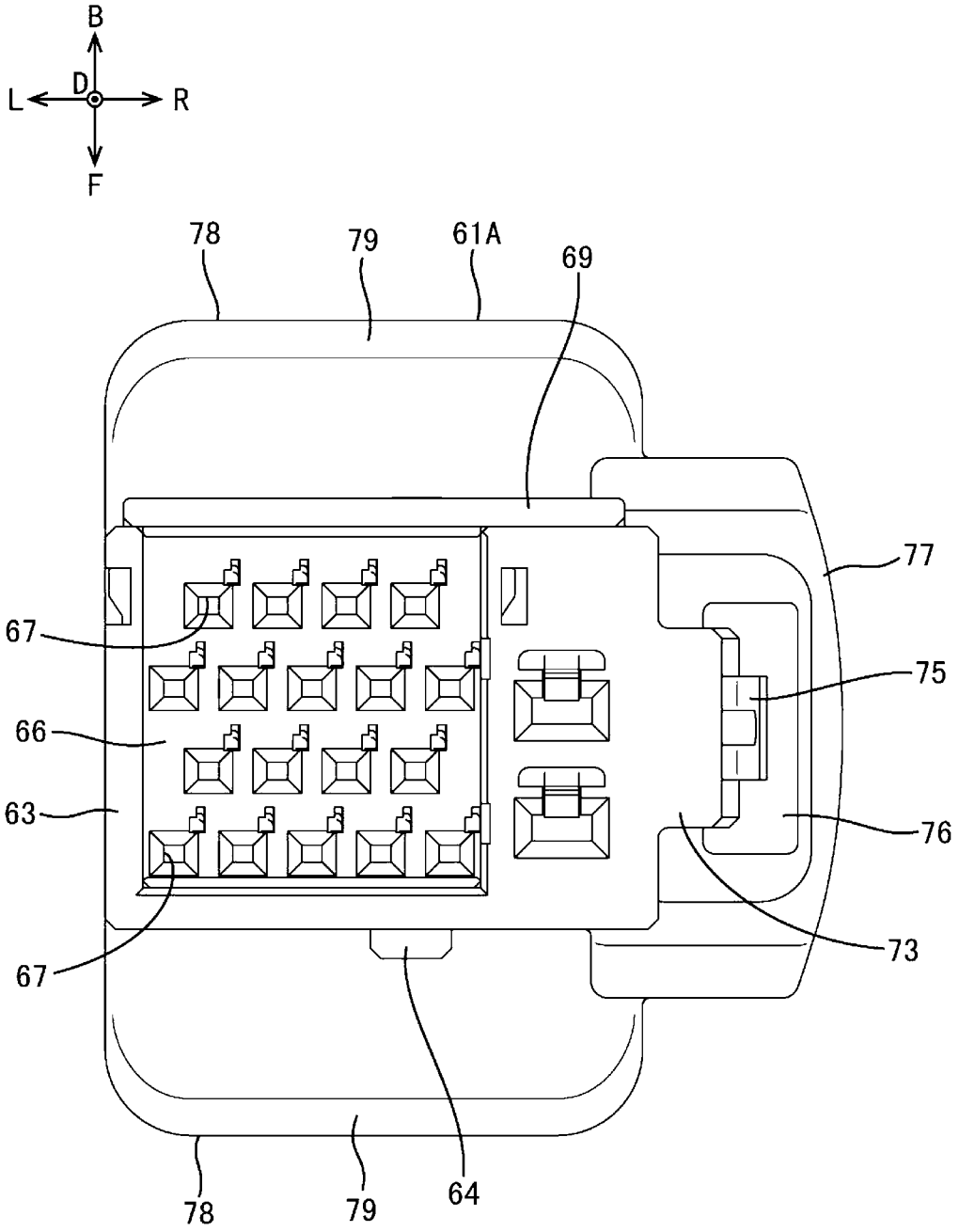
FIG. 5 is a bottom view of a mating housing.

The mating housing 61A, 61B is made of synthetic resin and includes, as shown in FIG. 5, a housing body 63 in the form of a rectangular block close to a square shape in a bottom view. The housing body 63 is shaped to be fittable into the accommodation chamber 32A, 32B. The mating housing 61A shown in FIGS. 5 to 7 is accommodated into the right accommodation chamber 32A of the board-side connector 21 in FIG. 2.

Figure 6:
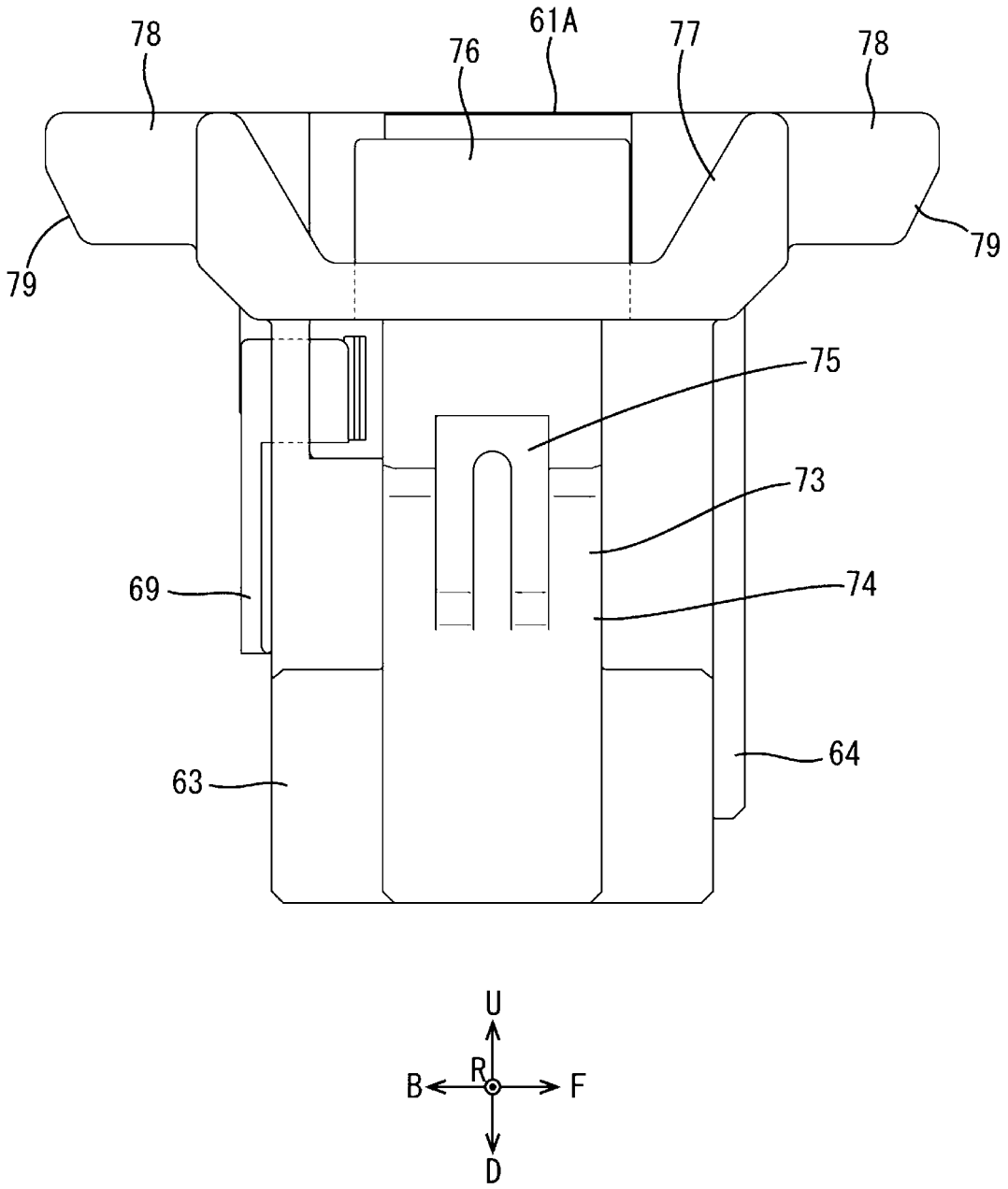
FIG. 6 is a side view of the mating housing.
Figure 7:
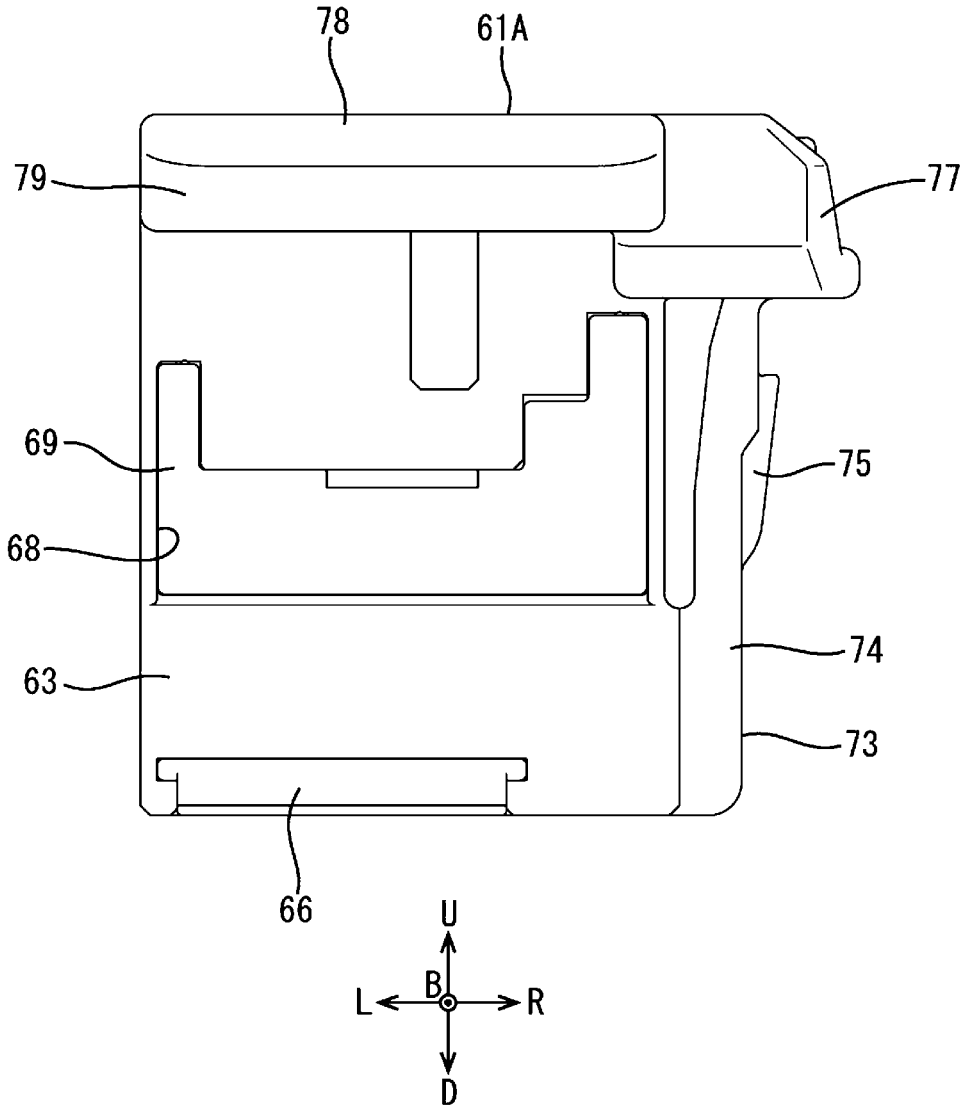
FIG. 7 is a front view of the mating housing.

As shown in FIGS. 5 and 6, a protrusion 64 for preventing erroneous fitting insertable into the recess 33 of the board-side connector 21 is provided on the front surface of the housing body 63. Note that the mating housing 61B to be accommodated into the left accommodation chamber 32B of the board-side connector 21 in FIG. 2 is different from the mating housing 61A in the formation position of the protrusion 64, but is similar to the mating housing 61A in other structures.

As shown in FIG. 2, the housing body 63 includes a plurality of cavities 65. The mating terminals 62 are inserted and accommodated into the respective cavities 65 of the housing body 63 from above. As shown in FIGS. 2 and 5, a plate-like member 66 is mounted to close the lower surface of the housing body 63. The plate-like member 66 includes a plurality of insertion holes 67 communicating with the respective cavities 65. As shown in FIGS. 2 and 7, the housing body 63 is provided with a retainer mount hole 68 communicating with the respective cavities 65 and open in the back surface of the housing body 63. A retainer 69 is inserted into the retainer mount hole 68 of the housing body 63 from behind.

The mating terminal 62 is made of conductive metal and includes, as shown in FIG. 2, a box portion 71 and a barrel portion 72 connected above the box portion 71. The barrel portion 72 is connected to an end part of a wire 90. The mating terminal 62 is locked by the retainer 69 and held retained in each cavity 65 of the housing body 63. The wire 90 connected to the mating terminal 62 is pulled out upward from the upper surface of the housing body 63. The mate connecting portion 24 of the board-side terminal 22A, 22B is inserted into the cavity 65 of the housing body 63 via the insertion hole 67 of the plate-like member 66 from below. The mate connecting portion 24 of the board-side terminal 22A, 22B is inserted into the box portion 71 for connection.

As shown in FIGS. 6 and 7, a mating lock portion 73 is provided to project on one side surface of the housing body 63. The mating lock portion 73 includes an arm portion 74 cantilevered upward from the lower end of the side surface of the housing body 63 and a lock projection 75 projecting from one side surface of the arm portion 74. The arm portion 74 is deflectable and deformable in the lateral direction with a lower end part connected to the one side surface of the housing body 63 as a fulcrum. The mating lock portion 73 is lockable to the board-side lock portion 35.

As shown in FIGS. 2 and 6, the mating lock portion 73 is provided with an operating portion 76 laterally projecting above the lock projection 75. A worker can release a locked state of the mating lock portion 73 and the board-side lock portion 35 by pressing the operating portion 76. As shown in FIGS. 1 and 6, an arched lock protecting portion 77 surrounding the operating portion 76 is provided on an upper end part of the one side surface of the housing body 63. The lock protecting portion 77 has a function of preventing an inadvertent releasing operation from being performed on the operating portion 76 and restricting excessive deflection and deformation of the arm portion 74.

The mating housing 61A, 61B includes a pair of front and back protruding portions 78 protruding forward from an upper end part of the front surface of the housing body 63 and protruding backward from an upper end part of the back surface of the housing body 63. Each protruding portion 78 is wall-like and arranged along the front-back direction with wall surfaces thereof facing upward and downward. As shown in FIG. 5, the respective protruding portions 78 are provided over the entire widths in the lateral direction of the front and back surfaces of the housing body 63. One side end part of each protruding portion 78 is coupled to the lock protecting portion 77. As shown in FIG. 1, the upper surface of each protruding portion 78 is arranged to be flat in the front-back direction and lateral direction and continuous with the upper surface of the housing body 63 without any step. As shown in FIG. 6, the lower surfaces of the respective protruding portions 78 are arranged along the front-back direction to rise in a direction orthogonal to the front and back surfaces of the housing body 63. Each protruding portion 78 has a slope 79 inclined downward in a tapered manner between the front or back end surface and the lower surface.

(Connector Connection Structure and Separation Method)

In assembling the board-side connector 20, when the respective board-side terminals 22A, 22B are mounted through the bottom wall 23 of the board-side housing 21, the board connecting portions 25 of the respective board-side terminals 22A, 22B are arranged to be exposed below the bottom wall 23 as shown in FIG. 4. As shown in FIGS. 3 and 4, the board connecting portions 25 of the respective front-row terminals 22A are arranged to project forward beyond the front wall 26 from below the front wall 26. The board connecting portions 25 of the respective back-row terminals 22B are arranged to project backward beyond the back wall 27 from below the back wall 27.

If the respective fixing members 41 are mounted on the left and right walls 28, 29, the board fixing portion 43 of the fixing member 41 mounted on the left wall 28 is arranged to project leftward and the board fixing portion 43 of the fixing member 41 mounted on the right wall 29 is arranged to project rightward.

The board-side connector 20 is heated in an unillustrated reflow furnace. In this way, the board connecting portions 25 of the respective board-side terminals 22A, 22B are soldered and connected to the conductive portions of the circuit board 100 and the board fixing portions 43 of the fixing members 41 are soldered and fixed to the circuit board 100.

Subsequently, the mating connector 60 having the mating terminals 62 set therein is arranged above the respective accommodation chambers 32A, 32B of the board-side connector 21, and the corresponding mating housings 61A, 61B are inserted into the respective accommodation chambers 32A, 32B from above. The worker can push the mating housings 61A, 61B into the accommodation chambers 32A, 32B by pressing the upper surfaces of the respective protruding portions 78 of the mating housings 61A, 61B with fingers. In the process of inserting the mating housings 61A, 61B into the accommodation chambers 32A, 32B, the lock projections 75 of the mating lock portions 73 interfere with the board-side lock portions 35 to deflect and deform the arm portions 74. Deflecting movements of the arm portions 74 are guided by the front and back guide walls 34. When the plate-like members 66 of the mating housings 61A, 61B reach positions to face and contact the bottom wall 23, the inserting operation of the mating housings 61A, 61B into the accommodation chambers 32A, 32B is stopped. When the mating housings 61A, 61B and the board-side housing 21 are properly connected in this way, the arm portions 74 are displaced in resilient return directions and the lock projections 75 are arranged to be lockable to the board-side lock portions 35 from below as shown in FIG. 2. In this way, the mating housings 61A, 61B are held retained in the accommodation chambers 32A, 32B of the board-side housing 21.

With the mating housings 61A, 61B and the board-side housing 21 properly connected, the respective mating terminals 62 and the respective board-side terminals 22A, 22B are also properly connected.

Further, with the mating housings 61A, 61B and the board-side housing 21 properly connected, upper end parts of the respective mating housings 61A, 61B are arranged to be exposed above the board-side housing 21. Specifically, the lock protecting portions 77 and the operating portions 76 of the respective mating housings 61A, 61B are arranged above the upper ends of the left and right walls 28, 29, and the respective protruding portions 78 of the respective mating housings 61A, 61B are arranged above the upper ends of the front and back walls 26, 27. More specifically, the lock protecting portions 77 and the operating portions 76 of the respective mating housings 61A, 61B protrude leftward and rightward beyond the left and right walls 28, 29, and the respective protruding portions 78 of the respective mating housings 61A, 61B protrude both forward and backward beyond the front and back walls 26, 27. Particularly, as shown in FIG. 1, the front protruding portions 78 are arranged to cover the board connecting portions 25 of the respective front-row terminals 22A from above, and the back protruding portions 78 are arranged to cover the board connecting portions 25 of the respective back-row terminals 22B from above. The board connecting portions 25 of the respective board-side terminals 22A, 22B are entirely covered and concealed by the respective protruding portions 78 in a plan view of the connector 10.

In separating the mating housing 61A, 61B and the board-side connector 21, the worker presses the operating portion 76 to deflect and deform the mating lock portion 73 and release the locked state of the lock projection 75 and the board-side lock portion 35. In that state, the worker pinches each protruding portion 78 with fingers and pulls up the mating housing 61A, 61B. As described above, the respective protruding portions 78 protrude forward and backward beyond the front and back walls 26, 27. Thus, the worker can hook fingers to regions extending from the lower surfaces to the slopes 79 of the respective protruding portions 78 and easily pull up the mating housing 61A, 61B. In this way, the mating housing 61A, 61B comes out from the accommodation chamber 32A, 32B and the mating housing 61A, 61B and the board-side housing 21 are separated from each other.

As described above, according to this embodiment, the respective protruding portions 78 of the mating housings 61A, 61B protrude toward both front and back sides from the front and back walls 26, 27 when the mating housings 61A, 61B and the board-side housing 21 are in a connected state. Thus, the worker can easily separate the mating housing 61A, 61B and the board-side housing 21 while pinching the respective protruding portions 78.

Moreover, since the respective protruding portions 78 are arranged to cover the board connecting portions 25 of the respective board-side terminals 22A, 22B from above when the mating housings 61A, 61B and the board-side housing 21 are in the connected state, the interference of an external matter with the board connecting portions 25 of the respective board-side terminals 22A, 22B from above can be avoided. As a result, the connection reliability of the board connecting portions 25 of the respective board-side terminals 22A, 22B and the circuit board 100 can be maintained.

Further, since the respective protruding portions 78 protrude in the front-back direction orthogonal to the lateral direction, which is an arrangement direction of the accommodation chambers 32A, 32B, with the mating housings 61A, 61B accommodated in the corresponding accommodation chambers 32A, 32B of the board-side housing 21, the mutual interference of the protruding portions 78 can be avoided. Furthermore, the enlargement of the board-side housing 21 in the lateral direction can be avoided.

Further, since the board-side lock portions 35 are provided on the left and right walls 28, 29, the enlargement of the board-side housing 21 in the front-back direction can be avoided unlike the case where the board-side lock portions 35 are provided on the front and back walls 26, 27. Further, unlike the case where the board-side lock portion 35 is provided on either one of the front and back walls 26, 27, the board-side housing 21 is easily set to have a front-back symmetrical shape. As a result, the front-row terminals 22A and the back-row terminals 22B can include terminals having the same shape and the types of the board-side terminals 22A, 22B can be reduced.

Further, in the mating housing 61A, 61B, the respective protruding portions 78 and the mating lock portion 73 are separately provided on three surfaces except one surface serving as a wall surface of the separation wall 31, out of four surfaces on the outer periphery of the housing body 63. Thus, the mutual interference of the respective protruding portions 78 and the mating lock portion 73 can be avoided and a degree of freedom in designing each can be enhanced.

Furthermore, the fixing members 41 and the board-side lock portions 35 are arranged at the positions overlapping each other in the front-back direction on the left and right walls 28, 29. Thus, even if the fixing members 41 are mounted on the left and right walls 28, 29, the enlargement of the board-side housing 21 in the front-back direction can be avoided. Moreover, since the board-side lock portions 35 are provided on the inner surfaces of the left and right walls 28, 29 and the fixing members 41 are mounted on the outer surfaces of the left and right walls 28, 29, a degree of freedom in designing each of the board-side lock portions 35 and the fixing members 41 can be enhanced.

Other Embodiments of Present Disclosure

The embodiment disclosed this time should be considered illustrative in all aspects, rather than restrictive.

Although two accommodation chambers are provided in the board-side housing in the case of the above embodiment, one, three or more accommodation chambers may be provided in a board-side housing as another embodiment. If the board-side housing includes one accommodation chamber, one mating housing may be provided.

Although the board-side lock portions are provided on both left and right walls in the case of the above embodiment, a board-side lock portion may be provided on either one of left and right walls as another embodiment. Further, board-side lock portion(s) may be provided on front and/or back wall(s).

Although the protruding portions are arranged to cover the entire board connecting portions of the board-side terminals from above in the case of the above embodiment, protruding portions may be arranged only to cover parts of board connecting portions of board-side terminals from above as another embodiment.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising:

a board-side housing configured to be installed on a circuit board, the board-side housing including front and back walls facing each other in a front-back direction, left and right walls facing each other in a lateral direction, and an accommodation chamber arranged between the front and back walls, between the left and right walls, and open upward; and a mating housing configured to be connected to the board-side housing; the mating housing including a housing body having an outer side surface and protruding portions protruding from an upper end of the housing body, wherein the left and right walls of the board-side housing including a board-side lock and the outer side surface includes a mating lock configured to be locked to the board-side lock, and the mating lock extends upward from a lower end of the housing body, and wherein when the mating housing is accommodated in the accommodation chamber:

the protruding portions are exposed above the board-side housing and protrude toward both front and back sides beyond the front and back walls, and the outer side surface of the mating housing faces the left or right wall of the board-side housing.

2. The connector of claim 1, wherein a plurality of the accommodation chambers are arranged side by side in the lateral direction in the board-side housing.

3. The connector of claim 1, wherein:

board-side terminals are mounted into the board-side housing, the board-side terminal includes a board connecting portion to be connected on the circuit board, the board connecting portions are exposed below the board-side housing and arranged to project toward the both front and back sides beyond the front and back walls, and the protruding portions are arranged to cover the board connecting portions from above with the mating housing accommodated in the accommodation chamber.

4. The connector of claim 1, wherein a fixing member for fixing the board-side housing to the circuit board is mounted on the left or right wall and arranged at a position overlapping the board-side lock in the front-back direction.

5. The connector of claim 1, wherein the board-side lock is provided on an inner surface of each of the left and right walls facing the accommodation chamber and the fixing member is mounted on an outer surface opposite to the inner surface, out of the inner and outer surfaces of the left or right wall.

6. The connector of claim 1, wherein the housing body of the mating lock includes an arm cantilevered upward from the lower end of the housing body, and an operating portion configured to release a locked state of the mating lock and the board-side lock when pressed to deflect the arm.

* * * * *